United States Patent [19]

Medinger

[11] 4,416,172

[45] Nov. 22, 1983

[54] APPARATUS FOR AUTOMATICALLY FEEDING SCREWS TO A SCREWING MECHANISM

[76] Inventor: Walter Medinger, Waldrand 7, D-6730 Neustadt, Fed. Rep. of Germany

[21] Appl. No.: 263,361

[22] Filed: May 14, 1981

[30] Foreign Application Priority Data

May 14, 1980 [DE] Fed. Rep. of Germany ..... 3018382

[51] Int. Cl.[3] ..... B25B 23/02

[52] U.S. Cl. ..... 81/57.37; 221/190; 227/113; 227/116

[58] Field of Search ..... 81/57.37, 435, 432, 81/433; 227/113, 116, 115, 107; 221/165, 190, 186

[56] References Cited

U.S. PATENT DOCUMENTS 3,820,705 6/1974 Beals ..... 227/113

FOREIGN PATENT DOCUMENTS 2027642 6/1970 Fed. Rep. of Germany ..... 81/57.37
184468 1/1964 Sweden ..... 81/57.37
701848 1/1954 United Kingdom ..... 221/165

*Primary Examiner*—James L. Jones, Jr.
*Attorney, Agent, or Firm*—Burns, Doane, Swecker & Mathis

[57] ABSTRACT

Apparatus automatically feeds screws to a screw-in tool of a screwing mechanism, especially a rapid constructional screwing mechanism. To simplify the feed of screws, a feed channel is provided which is arranged to provide relative movement between it and the screwing mechanism in the direction of the axis of the screwing tool. The screws gravitate along the channel. A container is fixedly connected with the screwing mechanism. A spring biases the feed channel and the screwing mechanism apart (up to a stop) until the screw pin is disengaged above the screw head. To screw-in the screw, the screwing mechanism is displaced downwardly toward the feed channel.

11 Claims, 7 Drawing Figures

APPARATUS FOR AUTOMATICALLY FEEDING SCREWS TO A SCREWING MECHANISM

BACKGROUND AND OBJECTS OF THE INVENTION

The invention concerns a device for the automatic feeding of screws to a screw driver pin of a screwing mechanism, especially a rapid constructional screwing mechanism.

Rapid constructional screwing mechanisms are used for turning in screws, e.g., wooden screws in wood plates of wooden strips, especially for fastening chip plates on the floor, with which a single screw can be screwed in mechanically without a manual screw driver (actuating by hand). Such a rapid constructional screwing mechanism has a form similar to a hand-boring machine and exhibits an opening on the front end, into which a screw pin is inserted and can be fastened. The screw pin is so designed on its free end that a cross slot screw head, for example, can be fitted therein. During the turning-in of the screw, the drive of the rapid constructional screwing mechanism is operatively coupled with the screw pin jutting out of the rapid constructional screwing mechanism. After fastening of the screw, the coupling between the drive and the screw pin is released, due to which the screw pin becomes stationary, while the drive motor continues to turn. As mentioned, screws mostly employ cross slot screw heads.

In the past, the operator had to insert each screw indvidually on the free end of the screw pin (or screw bit). This was very time consuming and the number of screwed-in screws per unit of time was thus very small. To accelerate this procedure, devices were developed in which the individual screws were automatically conducted to the screwing mechanism pin. With such a design, the screws are set in a belt, which is wound around a drum, the latter fastened to a rapid constructional screwing mechanism. The belt is designed as a U-shaped plastic belt, the side ends of which are slotted, and into which slots the screws are inserted. Such insertion is made in such a way that each screw runs parallel to the belt strap and vertically to the sides between the latter. The belt is then conducted out of a storage place which is designed as a drum, to an automatic feed mechanism, in which the belt is laid and which is fastened on the rapid constructional screwing device. The mechanism has a primary part, which is set up directly on the flooring, for example with the screwing operation, and a second part which is movable relative to the first part. The second part is firmly connected with the rapid constructional screwing device and there is a spring between both parts which attempts to press the two parts apart. To initiate the turning-in of the screws, both parts are moved toward each other against the pressure of the springs, due to which the screw is turned downward into the flooring.

In general, with such mechanism, up to about 150 screws can be processed with one filling of the storage place. The operation of the mechanism is very simple, and the work, i.e., screwing-in of screws, can be carried out very rapidly. It is apparent that the equipping of the belt with individual screws increases the price of each screw processed at the end, if one takes the price of each individual screw as a basis. There is also the fact that the screws must be held individually in the belt because of the elasticity of it. Finally, the head of each screw must be pressed through the slots transverse to the shanks, which causes a bending up of the shanks. Naturally the belt is not stiff, due to which the danger exists that in rough operation or during transport, the screws can fall out onto the construction site, and thus are lost. If for example, during the transport on the screw belt or on the container in which the screw belt is transported, a heavy piece falls, then the screws held in the concerned belt are at least partially lost and must be individually screwed-in.

It is the object of the invention to avoid these disadvantages and to enable screws obtainable on the market packed in packages up to about 500 etc., to be capable of use immediately without the need for a belt or similar mechanism.

SUMMARY OF A PREFERRED EMBODIMENT OF THE INVENTION

This object is solved according to the invention by the fact that a screwing mechanism is provided which is movable relative to the feed channel in the direction of the axis of the axis of the screwing tool. The screws are conducted along the channel from a container, firmly connected with the screwing mechanism, to the tool. A spring is arranged between the feed channel and the screwing mechanism, to press those members apart up to a stop so that the screw tool is disengaged from the top of a screw.

Mainly, the device according to the invention can be used only for screwing down of screws. Horizontal or upward screwing-in is not possible in this form because of the arrangement and design of the container for storing the screws and the design of the feed channel. Nevertheless, the advantages of the mechanism can be optimally utilized with screwing work in which screws are screwed-in precisely vertically downwardly or slightly slanted to the vertical, for example with the fastening of chip plates on the floor or similar cases of screwing-in joiners shops and so on. It is known that this work includes a very large part of the work to be carried out with rapid building screwing mechanisms. In any case, however, in connection with vertically downward or slanted screw-in operations, a considerable cost savings can be obtained in comparison to known devices, especially in the case of later use.

In an especially advantageous design, the feed channel can be formed of two wall parts arranged at a distance from each other, where the distance between both walls is greater than the screw outside diameter and smaller than the screw head outside diameter, so that the screw head always remains above the wall parts. Futhermore, the wall parts are conducted in the container in an advantageous manner and then, when the screwing-in operation is concluded, these project above a floor of the container. So that the screws can slide out of the container to the screwing-in site by gravity, the walls parts are slightly slanted downwardly toward the screwing site on the edge found in the container.

In the area of the screwing site, the distance between the wall parts is widened in such a way that a screw head can pass downwardly therethrough.

For optimum guiding of the screw, a permanent magnet can be found in the area of the screwing site, whose magnetic attraction force attracts the screw and holds it in the screwing-in direction until the screw is engaged by the rool.

Further advantageous designs and improvements are to be found in the additional subclaims.

The mechanism words as follows: Non-magnetized (but magnetizable) screws, i.e., those screws which are obtainable on the market packed in packages of say 500, are filled into the supply container, in which they lie freely. By means of the feed channel arranged at the base of the container, the screws are first spatially arranged so that the screw heads slide on the upper edges of the feed channel, while the screw bodies hang down because of the force of gravity. Due to the downward movement of the container, together with the rapid constructional screwing mechanism, relative to the feed channel, the alignment of the screws is further promoted. In other words: in the screwing operation, when the screwing mechanism is pressed downwardly relative to the feed channel, then necessarily a certain shaking-up of the screws within the container takes place, due to which the screws, or at least some of them, come with their bodies between the wall parts. By frequent pressing down of the screwing mechanism, this action is further promoted. The screws then slip down in the direction of the screw pin, to which they are fed individually after running through a separation mechanism and are put into the correct position. The alignment of the screws in the area of the screw tool and the holding fast of same in the area of the screw tool (this holding-fast is necessary since the feed channel is widened in this area and the screw heads would otherwise simply fall through), takes place by a rod-like permanent magnet. The magnet is aligned directly outside of the movement area parallel to the movement direction of the screw tool and operates, as mentioned above, by the magnetic attractive force which aligns the individual screws. Due to this, the screw head comes to lie directly under the screw tool. By pressing down the rapid constructional screwing device, wall parts or components exhibiting the feed channel lie with their support on the floor and the screws can be screwed-in with the conventional running drive motor of the rapid constructional screwing device. The spring assures that after a screw-in operation, the feed channel becomes again disposed below the base of the container. A new screw simultaneously arrives in the area of the screw tool and can be screwed-in. A manual feed of the screws to the screw pin is then no longer necessary.

THE DRAWING

The invention as well as other advantageous designs of same will be explained and described in more detail on the basis of the drawing, in which a design example of the invention is more closely explained and described.

DETAILED DESCRIPTION OF A PREFERRED EMBODIMENT OF THE INVENTION

Figure 1:
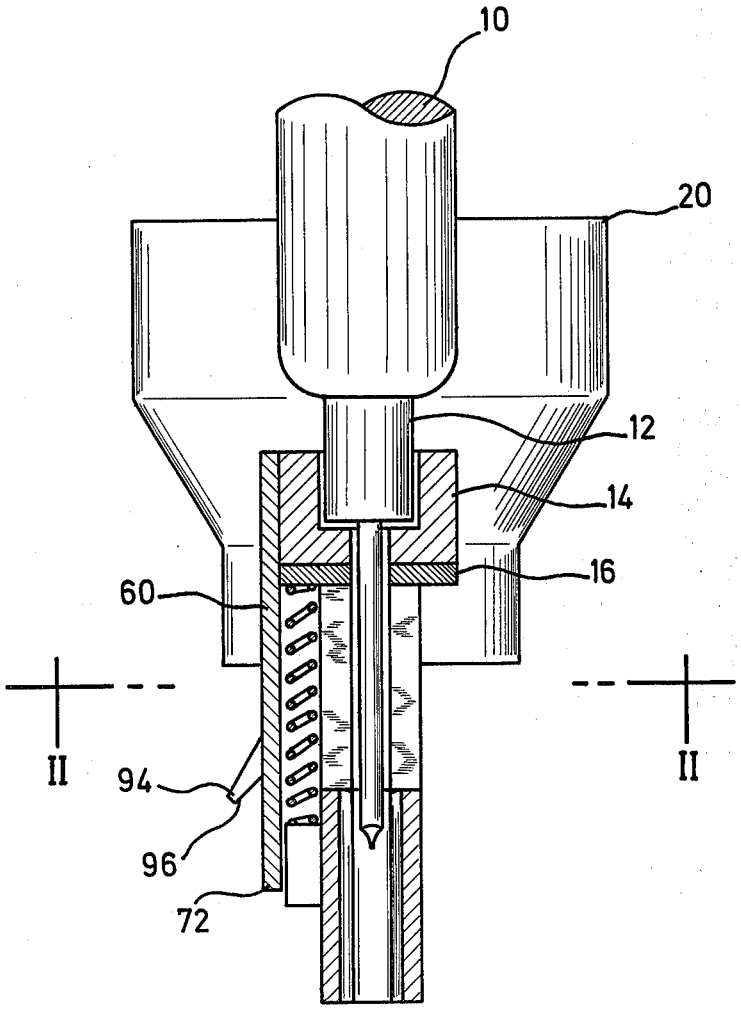
FIG. 1 shows a partial cross-section through the rapid constructional screwing mechanism, according to the invention.
Figure 3:
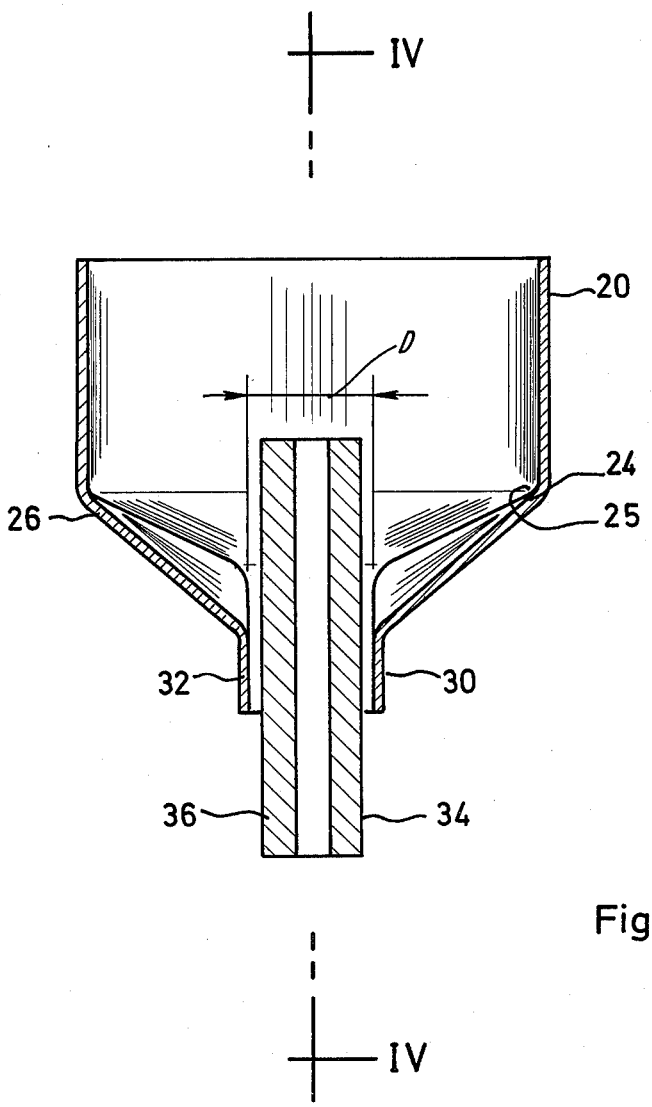
FIG. 3 shows a sectional view taken along line III—III in FIG. 4.
Figure 4:
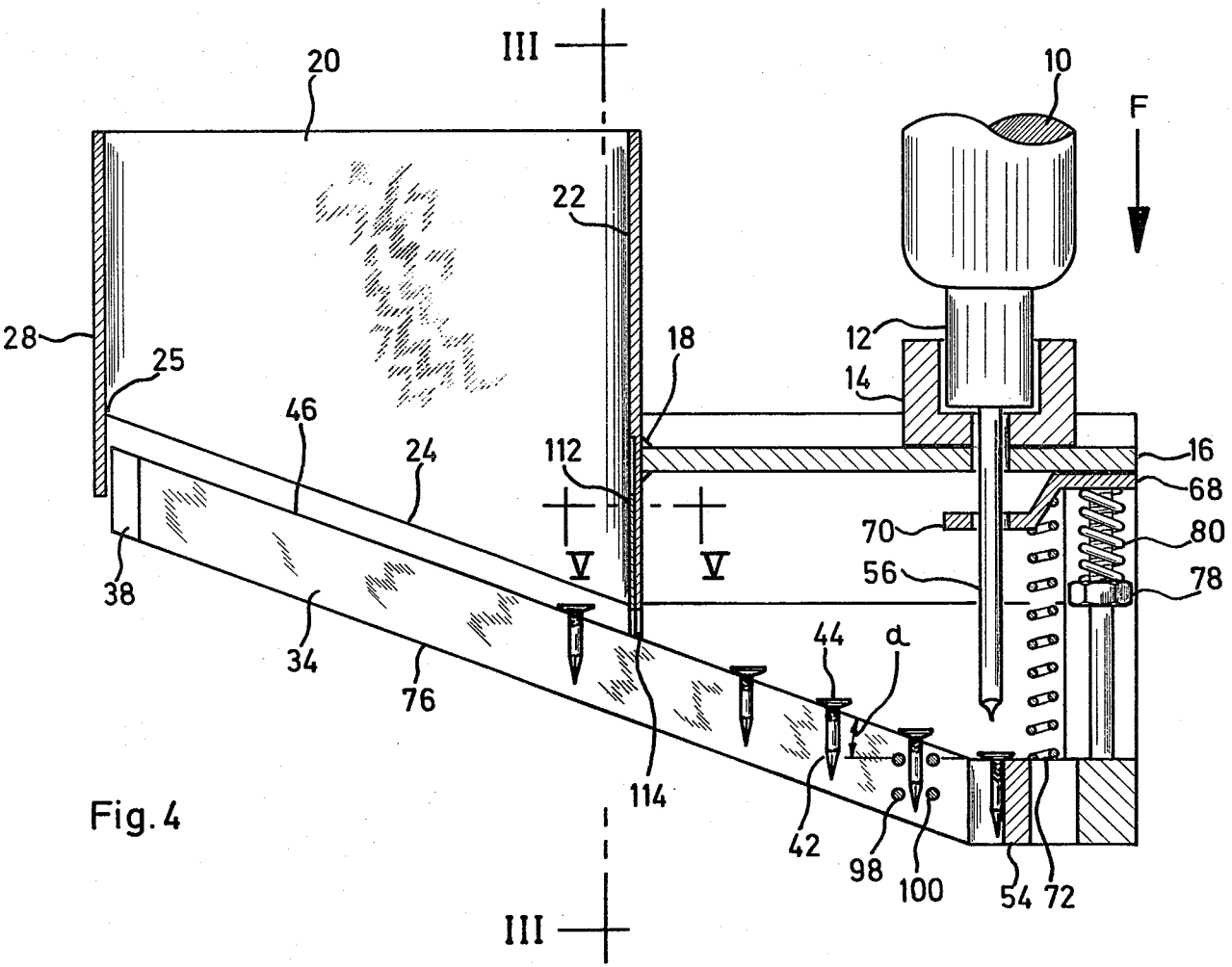
FIG. 4 shows a sectional view taken along line IV—IV of FIG. 3.

FIG. 1 shows a partial cross-section of a mechanism according to the invention. There is depicted a rapid constructional screwing mechanism 10, which is clamped in a fixed clamping element 14 vertically downward with a downward jutting clamping element or chuck 12. The fixed clamping element 14 is fastened in a loosenable manner on the upper side of a carrier 16, which carrier 16 is fastened by means of a weld connection 18 on a container 20, perpendicularly relative to its front side wall 22 (see FIG. 4). The container 20 has an approximately rectangular shape and, as shown in FIG. 3, is provided with downward inclined base walls 24 and 26, which extend obliquely toward the center from side walls of the container (FIG. 3) and extend from the rear wall 28 forwardly and downwardly to the front wall 22. Both base walls 24, 26 end in edges 30 and 32, which form a space D between them, through which two oppositely lying wall parts 34 and 36 extend. The two wall parts, of which one sees only the wall part 34 in FIG. 4, are kept apart by a distance d by means of a strip 38 indicated in FIG. 4 at the left and by another strip 40 (see FIG. 2), which can be formed in one-piece with both wall parts. This distance d is slightly larger than the screw body 42, but smaller than screw head 44, so that, as seen from FIG. 4, the screw head slides on the upper edges 46 of the wall parts. The upper portions of the wall parts thus form a feed channel 52 for the individual screws. This feed channel 52 is inclined steeply parallel to the base walls 24, 26, so that the screws can gravitate down the slanting plane during the work.

The steep plane widens out in the area of the screwing-in site 48 in such a way that a circular opening 50 is formed. The feed channel 52 discharges between wall parts 34, 36. The opening has a diameter so large that the screw heads 44 can fall through in a downward manner.

A rod-like permanent magnet 54 is arranged in the area of the screwing-in site 48, which magnetic is aligned with the screwing-in direction. As shown in FIG. 4, the magnet attracts screws 42/44 with its magnetic attractive force and aligns them exactly with the rapid constructional screwing mechanism 16. It is recognized from FIG. 4 that a screw tool or pin 56 is clamped in clamping element 12 to be fitted into the slot or the crosswise slit on the screw head. The permanent magnet 54 is aligned so that the screw 42 adhering to it has its axis aligned with the axis of the screw pin 56.

FIG. 4 shows a mechanism before the screwing process begins. For screwing-in, the screwing mechanism 10 must be displaced downwardly in arrow direction F by conventional means such as a fluid or electric motor, whereupon the container 20 is moved downwardly over the wall parts 34, 36. So that this can be carried out in an optimum manner, a holding wall 60 is fastened on the container 20 and extends parallel to the wall parts 34, 36. On the free end of the wall 60 a guide strip 62 is fastened and extends parallel to the screwing-in direction. The strip 62 terminates in a C-shaped groove 64. A T-shaped formation 66 is present on strip 40, which is conducted in the groove 64 and slides along it. Furthermore, a guide element 68, bent at right angles, is fastened on carrier 16, which element 68 juts into the path of screw pin 56 and surrounds this, so that the screw pin slides through an opening 70 in the guide element 68. A pressure spring 72 is arranged between the carrier 16 and a stop 71 mounted on the strip 40 or on the wall part 36. The spring is designed as a spiral spring and surrounds a pin 74 serving as a guide. The guiding of the wall parts 34, 36 relative to the container 20 and the rapid construction screwing mechanism thus takes place by means of the guide strip 62 and/or both edges 30 and 32.

It is therefore recognized that both components, i.e., the container 20 with rapid constructional screwing mechanism 10 and the holding wall 60 can be shifted against the pressure of helical springs72 relative to wall parts 34 and 36 in the direction of arrow 11. Accordingly, the edge 76 of wall parts 34, 36 lying opposite the edges 46 extend, in the area of the screwing-in site, generally perpendicularly relative to the screw-in direction and parallel to the feed channel 52. Thus, the edges 76, 46 and channel 52 each form a sharp angle $\alpha$ with the horizontal. The edges 76 therefore have an inclination to the horizontal, to provide a cant or slanting position of the mechanism. The angle $\alpha$, in the case of the guide channel, should not be too small, since otherwise the slipping down of the screws is prevented due to the frictional force to be overcome between the edges 46 and the screw heads 44. The amount of angle $\alpha$ is thus dictated simply by friction between heads 44 and edge 46. Naturally, the guide channel does not need to be parallel to edges 76, but such a relationship has proven to be practical for the manufacture of the wall parts 34, 36.

An adjusting screw 78 is screwed onto the underside of the carrier 16 in the area of the guide element 68, and a spiral spring 80 is provided between the head and the guide element 68. The screw 80 serves for adjusting the maximum path between the FIG. 4 park position (relaxes spring) and the completely screwed-in position (not shown in the figure).

Figure 2:
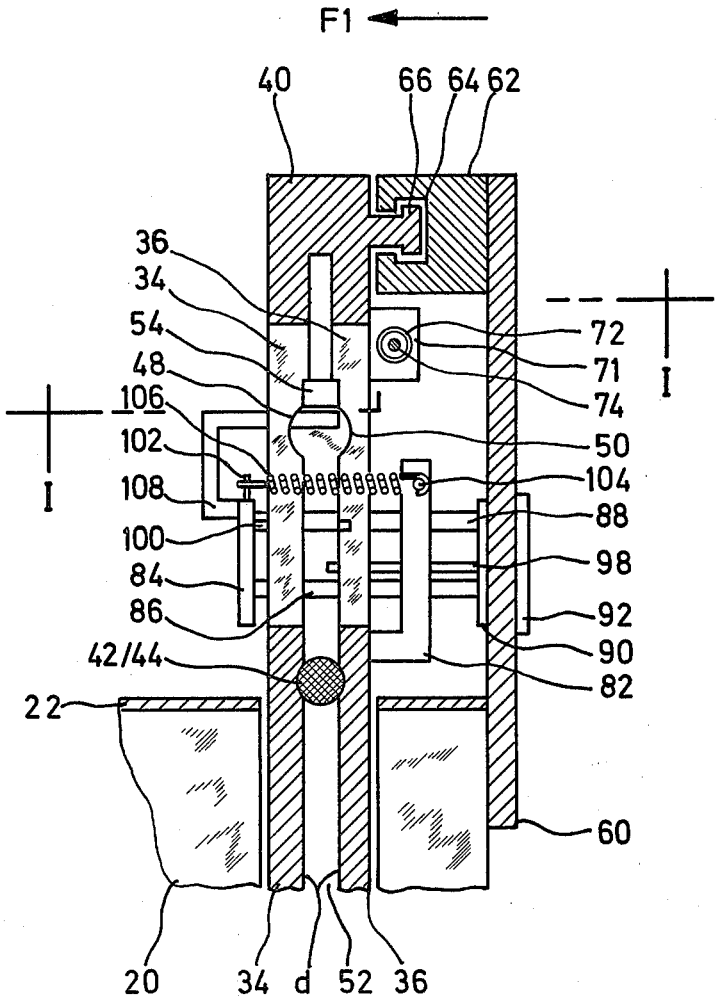
FIG. 2 shows a sectional view of the mechanism according to the invention taken along line II—II of FIG. 1.

FIG. 2 shows a separating mechanism, which is known as such from VDI 3 240. (Association of German Engineers). A sheet metal plate 84 is provided on the outer surface of the opposite lying wall 34. On the plate 84 are fastened guide pilots 86 and 88, which guide pilots extend through wall parts 34, 36 and are firmly connected with another guide plate 90 on the other side of wall part 36. The guide plate 90 partially juts through the holding wall 60. The holding wall 60 has a recess 92, which is formed by bending out a cover plate 94 (FIG. 1), which cover plate forms an oblique surface 96. A pressing down of the rapid constructional screwing mechanism 10 together with the holding wall 60, the surface 96 presses the guide plate 90, together with the guide rods 86 and 88, transverse by relative to wall parts 34, 36 in arrow direction F1. Separation pins 98 and 100 are disposed between the guide pins 86 and 88. A tension spring 106 is arranged between the extension 102 on the guide plate 84 and a pin 104 on element 82, which spring 106 acts upon the separation mechanism and especially both holding and guide plates 84 and 90 always against arrow directon F1, so that the guide plate 84 is always urged toward the outer surface of wall part 34. The separation pin 98 is dimensioned in such a way that it juts beyond the inner surface of wall part 36, even if only slightly, so that sufficient space remains between the inner surface of wall part 34 and the end of separation pin 98 for the passage of a screw. The separation pin 100, in connection with plate 84 in the depicted position, is formed in such a way that it extends the distance d, so that a screw comes to lie in the space between both separation pins 98, 100 and is held fast there. When the rapid constructional screwing device 10 is pressed down, the cover plate or the slanted surface 96 cams the guide plate 90 and presses the latter in arrow direction F1, so that the free end of the separation pin 98 at least partially goes into the inner wall of wall part 34, whereas the free end of separation pin 100 practically draws back into the inner surface of wall part 34 and thus the screw lying between both separation pins is released for travel downwardly to area 48. Then the previous screw pin disposed in the area 48 is screwed-in. When the screwing device 10 is released, the separation devices moves into the position shown in FIG. 2. The screw found between pin 100 and area 48 gravitates to the permanent magnet 54, whereas a new screw slides into the area between both separation pins. The new screw is prevented from sliding further by the separation pin 100. An approximately U-shaped clamp 108 is formed on guide plate 84, which in a rest position (shown in FIG. 2), extends into the interior of area 48. The clamp 108 locks the separation mechanism in a missoperation as soon as a screw adheres to the magnet, so that a second screw cannot slide down, as then, when a screw adheres to the magnet, the leg of the clamp 108 abuts against the outer surface of the screw, and thus the clamp 108 which is fixed to the plate 84 holds the separation pin 98 so that the pin 98 crosses the distance between the wall parts 34 and 36 fully and makes an obstacle for a further screw. That screw thus cannot enter the space between the separation pins 98 and 100.

The wall parts 34, 36 are dimensioned in such a way that in the state shown in FIG. 4 (released helical spring 74), they lie below the base 25. During screwing-in, the rapid constructional screwing mechanism 10 is passed down together with the carrier 16 and the container 20, and the upper edges 46 of wall parts 34 and 36 become located above the base 24 (as one can see for example from FIG. 3, in which a position is shown at the conclusion of the screwing operation). The upper edges 46 of both wall parts 34 and 36, as can be recognized, have clearly extended above the base parts or base walls 24 and 26.

Figure 5:
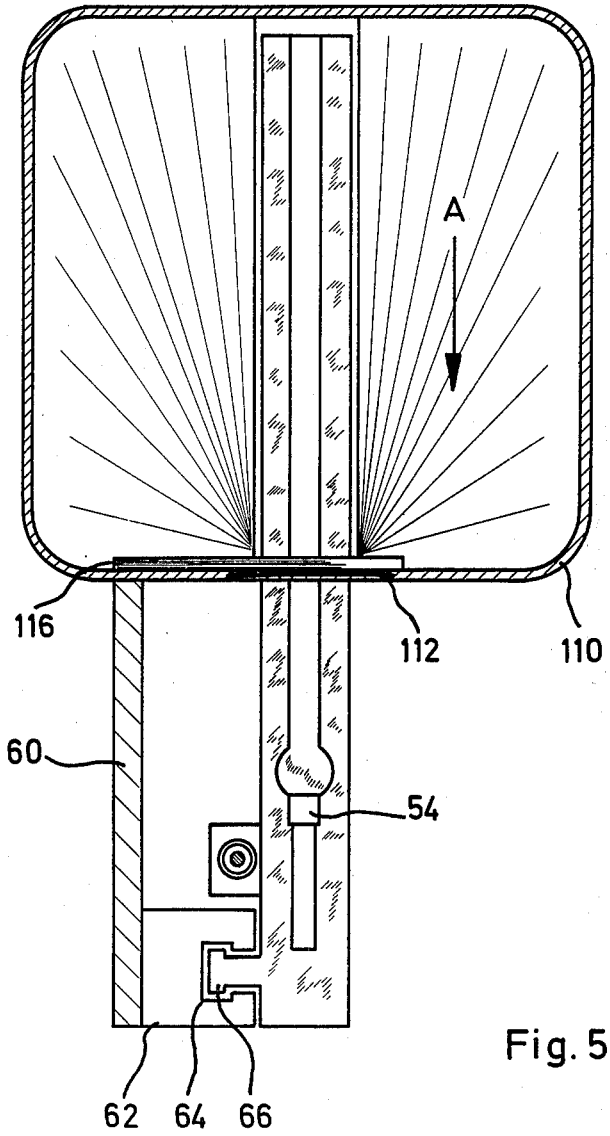
FIG. 5 shows a cross-sectional view taken in the direction of line V—V.
Figure 6:
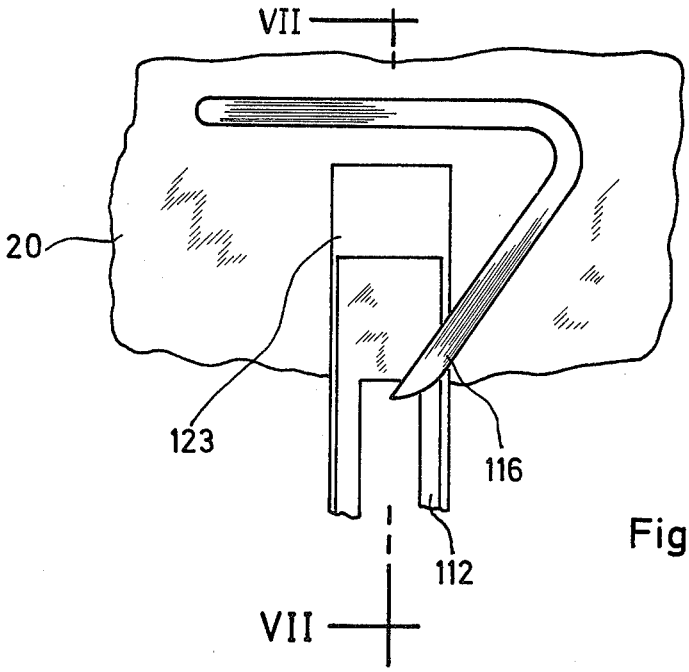
FIG. 6 shows a downward view in arrow direction A of FIG. 5.
Figure 7:
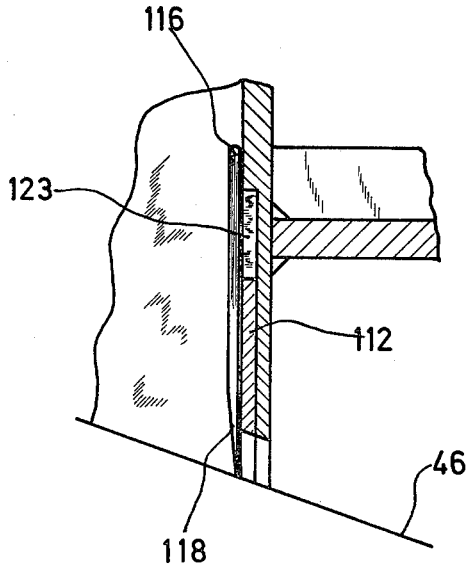
FIG. 7 shows a sectional view of the arrangement taken along line VII—VII of FIG. 6.

The relative movement of the container 20 and wall parts 34 and 36 requires that the front wall 22 be provided with a slot. This slot is visible in FIG. 5 and is designated by reference number 110. So that the screws cannot fall out forwardly through the slot 110 in the released state (FIG. 4), an extenson 112 is fastened on the wall parts 34, 36, which extension is guided into slot 110. The extension has an opening 114 in the area of the edges 46 or the guide channel 52, which forms a tunnel passage and is dimensioned in such a way that the screw heads 44 can slip therethrough. This extension can also be referred to as a pusher.

So that no screw accumulation takes place in the area of pusher 112, a bommerang-like bent steel spring 116 is provided on the inner wall or the inner surface of the front wall 22, whose free end 118, pointing to the upper edges 46, is faceted, so that each screw is pre-arranged in a suitable form. The free end 118 is spaced above the feed channel by a distance slightly greater than the height of a screw head.

In summary, the way the arrangement works can be described as follows: as many screws are put into the container at random as the container can hold. The screwing mechanism 10 is pressed down for the first time, whereby the container moves relatively to the wall parts 34, 36 lying on the ground, until the upper edges 46 of the wall parts 34, 36 extend above the base walls 24, 26.

It is to be assumed that the first time at least one screw has fallen between both wall parts 34, 36 and slides along edges 46 to the separation mechanism 98, 100. After this, the rapid screwing device 10 is released or lifted-up by or with the help of the spring 72. By setting the container and rapid screwing device 10 onto the wall parts 34, 36, the latter are vibrated, whereby other screws fall between the wall parts 34, 36 and slide down. Also, relative movement between the container and channel shakes-up the screws to promote entry thereof into the channel. When the rapid screwing device 10 is then pressed down, the first screw travels from between both separation pins 98 and 100, and the second screw lies against the back of the separating pin 98. (Instead of an individual separating pin 98 and 100, two can be arranged above each other (see FIG. 4), which is thought to be practical because of a better alignment of the screw bodies 42).

If desired after a repeated release, the rapid constructional screwing device 10 together with screw pin 56 moves upwardly in the direction of the arrow F1, so that the free end 58 of the screw pin 56 comes to lie above the feed channel 56. Due to this, the next screw, which has passed the separation pin 100, slides against the permanent magnet 54 on which it is aligned in such a way that its axis coincides with the axis of the screw pin. By then pressing down the screwing mechanism 10 and the meeting of the free end 58 on the upper surface of screw head 44, the free end 58 engages with the slots or the slot of the screw head, so that the screw can be screwed downward in arrow direction F. After releasing the screwing device 10, the next screw comes to lie against the permanent magnet and the screwing-in process can be repeated.

Although the invention has been described in connection with a preferred embodiment thereof, it will be appreciated by those skilled in the art that additions, deletions, modifications, and substitutions may be made without departing from the spirit and scope of the invention as defind in the appended claims.

What is claimed is:

1. Apparatus for automatically feeding screws to a screwing mechanism which includes a rotary screw tool at a screw-in site, said apparatus coprising:

a container fixedly connected to said screwing mechanism, said container adapted to contain a supply of screws, a feed channel communicating said container with said screw tool to guide screws from said container to a position aligned with a longitudinal axis of said tool, said feed channel and tool being mounted to provide for relative movement therebetween in a generally up and down direction of said longitudinal axis to selectively engage and disengage said tool and an aligned screw, and spring means arranged to act against said feed channel and screwing mechanism to urge said feed channel and screwing tool apart toward a screw-disengaging condition.

2. Apparatus according to claim 1, wherein said channel is formed by a pair of spaced walls, upper edges of which being parallel to lower edges thereof; the upper edges extending in an angle to a horizontal plane.

3. Apparatus according to claim 1, including an adjustment mechanism for limiting relative converging movement between said feed channel and tool.

4. Apparatus according to claim 1, including separating means adjacent said screw-in site for separating said screws such that the screws are fed individually to said screw-in site.

5. Apparatus according to claim 1, including a U-shaped clamp connected to said separating mechanism to lock the latter when a screw is at the screw-in site.

6. Apparatus according to claim 1, including orienting means in said container for orienting the screws in a predetermined orientation.

7. Apparatus according to claim 6, wherein said orienting means comprises a generally L-shaped bent steel spring one end of which is fastened to an inner wall of said container, the other end being spaced above said feed channel by a distance slightly greater than the height of a screw head.

8. Apparatus according to claim 1, wherein said feed channel is formed by a pair of spaced apart walls projecting into said container, said container and feed channel arranged such that during a screwing operation, upper edges of said walls travel relative to said container to a level above a base of said container.

9. Apparatus according to claim 1, wherein said feed channel slants toward said screw-in site such that screws gravitate along said channel from said container to said screw-in site.

10. Apparatus according to claim 1, wherein said feed channel is formed by a pair of spaced-apart walls, which spacing widens at said screw-in site.

11. Apparatus according to claim 1, including a permanent magnet disposed at an end of said feed channel adjacent said screw-in site to retain the screws individually in position for engagement by said tool.

* * * * *